US005709449A

United States Patent [19]

Kuo

[11] Patent Number: 5,709,449

[45] Date of Patent: Jan. 20, 1998

[54] LIGHT-EMITTING ATTACHMENT

[76] Inventor: Ming-Shish Kuo, No. 170, Section 2, Ming-Tsu Road, Tainan, Taiwan

[21] Appl. No.: 825,816

[22] Filed: Apr. 3, 1997

[51] Int. Cl.[6] ..... F21K 2/00

[52] U.S. Cl. ..... 362/34; 362/363; 362/806

[58] Field of Search ..... 362/34, 84, 363, 362/806

[56] References Cited

U.S. PATENT DOCUMENTS 5,018,450 5/1991 Smith ..... 102/513

5,344,670 9/1994 Palmer et al. ..... 427/157

5,552,968 9/1996 Ladyjensky ..... 362/34

*Primary Examiner*—Stephen F. Husar

[57] ABSTRACT

Illumination is provided by a transparent body having two separate chambers for containing different liquids which are mixed together when a guide tube is pressed to provide communication between the chambers and the body is shaken.

3 Claims, 2 Drawing Sheets

LIGHT-EMITTING ATTACHMENT

BACKGROUND OF THE INVENTION

This invention concerns a light-emitting attachment for ornaments such as Christmas lamps, decorative eggs and the like.

Common ornaments are usually enjoyed during daytime, but during nighttime they have to be illuminated with a bright light, otherwise they cannot be seen for enjoyment.

SUMMARY OF THE INVENTION

This invention provides a light-emitting attachment to be utilized with ornaments of a small size, such as Christmas lamps, decorative eggs, small animal dolls and the like.

The main feature of the present invention has two kinds of chemical solutions filled in two separate chambers in a body. When the two differenct chemical solutions are mixed together, the mixed solutions provide illumination guide tube with a lengthwise passageway in the tube body is pressed down to provide communication between the two liquid filled chambers. The body is thereafter shaken to mix the solutions and create illumination.

BRIEF DESCRIPTION OF DRAWINGS

This invention will be better understood referring to the accompanying drawings, wherein.

DETAILED DESCRIPTION OF THE PREFERRED EMBODIMENT

Figure 1:
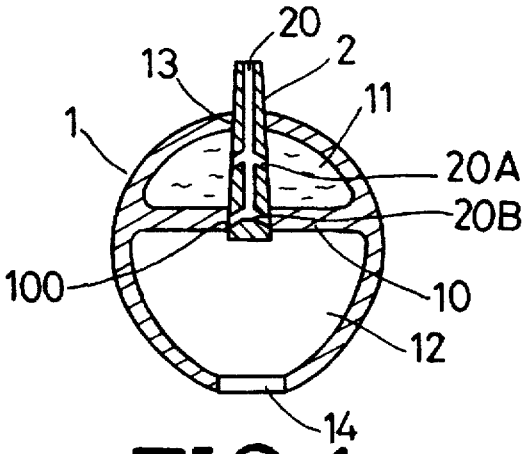
FIG. 1 is a cross-sectional view of a light-emitting attachment in the present invention, showing it in a half filled condition.
Figure 2:
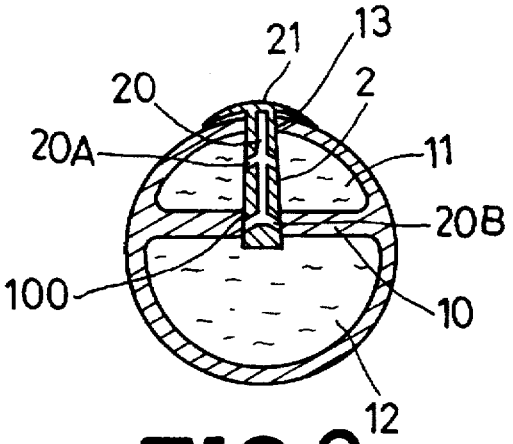
FIG. 2 is a cross-sectional view of a light-emitting attachment in the present invention, showing it in a fully filled condition.

A light-emitting attachment in the present invention, as shown in FIG. 1, has a transparent body 1, a wall 10 dividing the interior of the body 1 into two separate chambers 11,12 for separately containing two different chemical solutions therein. A center hole 100 is bored through the wall 10, and an opening 13 is provided in an upper wall portion of the body 1, an inlet hole 14 is provided in a bottom wall portion of body 1 and a tapered guide tube 2 is inserted through the inlet hole 14 from the exterior and fitted in the center hole 100 of the wall 10, with its upper end projecting out of the opening 13. Tube 2 has a lengthwise passageway 20 with two spaced short fork-shaped passages 20A, 20B extending laterally from the passageway 20 to two sides thereof. The upper fork-shaped passage 20A normally communicates with upper chamber 11, while the lower fork-shaped 20B is sealed by the interior wall of hole 100. A first chemical solution, such as oxalic acid, is filled through the lengthwise passageway 20 and passage 20A into the first chamber 11, and the projecting end of the guide tube 2 of the body 1 is heat melted into a flat push block 21, thus closing up the upper opening of the guide tube 2 and the opening 13 of the body 1. Thereafter, the body 1 is inverted and a second chemical solution, such as hydrogen peroxide, is filled through the bottom hole 14 into second chamber 12, with the bottom hole 14 being thereafter closed up by heating and melting the adjacent portion of body 1.

Figure 3:
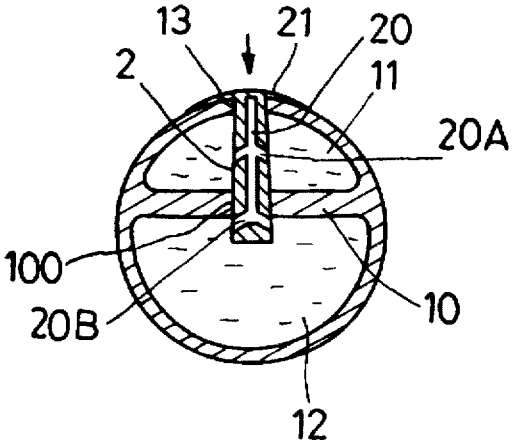
FIG. 3 is a cross-sectional view of a light-emitting attachment in the present invention, showing how the two different chemicals are mixed with each other; and, FIG. 4 is an elevational view of the light-emitting attachment of the present invention as used in Christmas ornaments.
Figure 4:
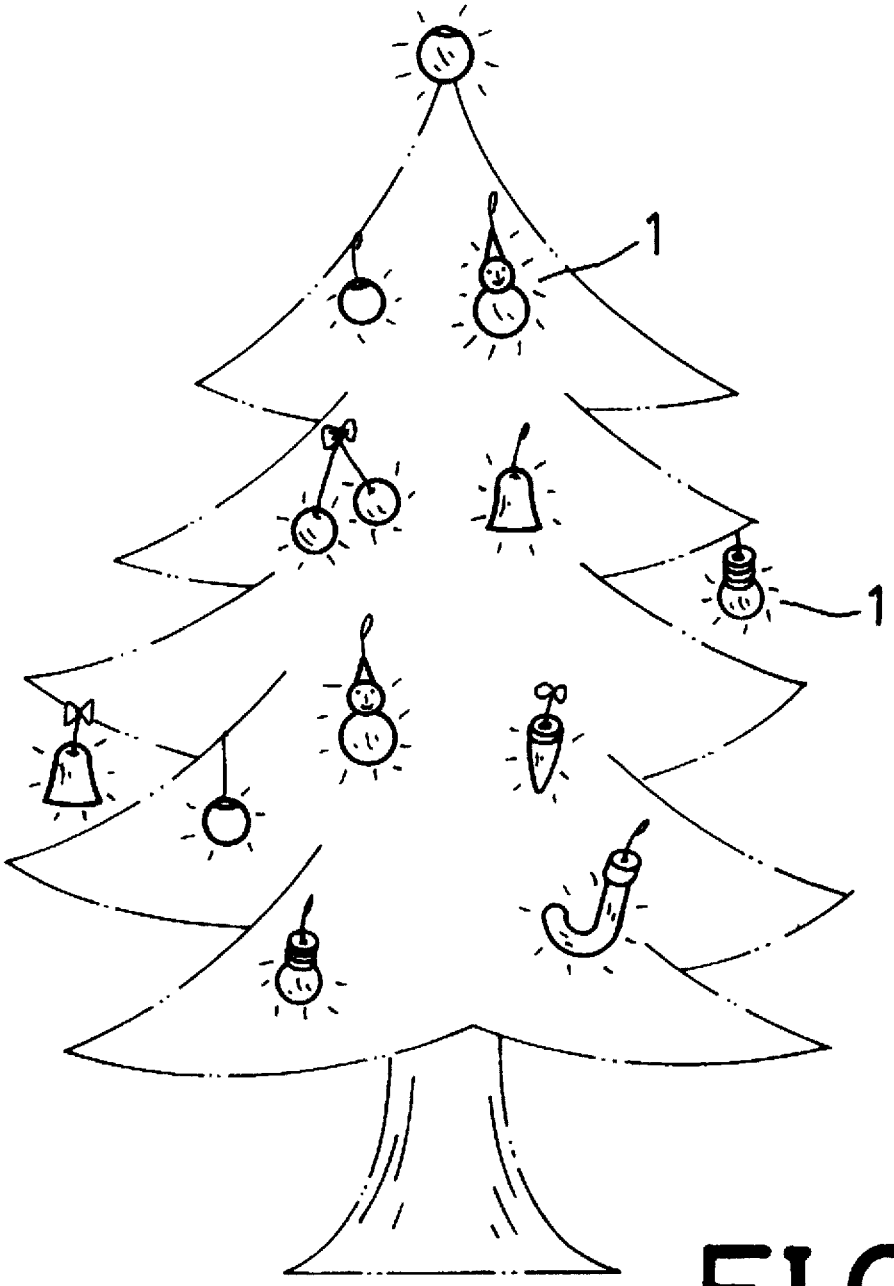

In use, referring to FIG. 3, the flat push block 21 of the guide tube 2 is pressed down to provide communication between chambers 11, 12 through passage 20B, passageway 20 and passage 20A. Body 1 is then shaken to mix the different solutions in chambers 11, 12, thereby creating illumination from the mixture. This light-emitting attachment for ornaments may be used in Christmas lamps, any other lamps of any shape and small animals dolls or the like, as shown in FIG. 4.

While the preferred embodiment of the invention has been described above, it will be recognized and understood that various modifications may be made therein and the appended claims are intended to cover all such modifications which may fall within the spirit and scope of the invention.

What is claimed is:

1. A light-emitting attachment comprising:

a) a hollow transparent body including a wall dividing the interior of the body into a first chamber and a second chamber, a center hole extending through the wall, the first chamber including an upper portion provided with a first hole extending therethrough, and the center and first holes being in alignment;

b) a guide tube extending through and positioned between the center and first holes, the guide tube including a longitudinal passageway, an upper passage extending laterally from the longitudinal passageway, a lower passage extending laterally from the longitudinal passageway, and an end projecting outwardly of the first hole and terminating in a push block on an exterior side of the upper wall portion;

c) a first solution contained within the first chamber, a second solution contained within the second chamber and the solutions being capable of providing illumination when mixed together; and, d) wherein when the attachment is in an unactivated condition, the guide tube prevents communication between the first and second chambers and upon activation by a user pressing inwardly on the push block, the guide tube is caused to move inwardly into the second chamber, thereby providing communication between the first and second chambers through the lower passage, longitudinal passageway and upper passage, thereby permitting mixing of the solutions when the body is shaken.

2. The attachment of claim 1 wherein the guide tube includes an outer surface that is tapered inwardly towards the upper wall portion.

3. The attachment of claim 1 wherein the upper passage and the lower passage are each of a fork-shaped configuration extending downwardly and outwardly toward opposite sides of the guide tube.

* * * * *